United States Patent [19]

Arai

[11] 4,070,822

[45] Jan. 31, 1978

[54] TIMER MECHANISM FOR USE IN A CLOCK

[75] Inventor: Kiyoyuki Arai, Tokyo, Japan

[73] Assignee: Copal Company Limited, Tokyo, Japan

[21] Appl. No.: 724,525

[22] Filed: Sept. 20, 1976

[30] Foreign Application Priority Data

Sept. 22, 1975 Japan ..... 50-114442
Dec. 18, 1975 Japan ..... 50-151407

[51] Int. Cl.[2] ..... G04B 23/00; G04C 21/16; H01H 7/08

[52] U.S. Cl. ..... 58/38 R; 58/16 D; 58/19 A; 200/38 A; 200/38 C

[58] Field of Search ..... 58/2, 16, 19 R, 19 A, 58/23 D, 38, 39, 125 C, 152 B; 200/DIG. 7, 36, 37 R, 37 A, 38 R, 38 A, 38 C, 38 CA; 340/309.6

[56] References Cited

U.S. PATENT DOCUMENTS 3,686,879 8/1972 Hummel et al. ..... 58/38
3,996,734 12/1976 Kitai ..... 58/19 A

*Primary Examiner*—E. S. Jackmon
*Attorney, Agent, or Firm*—J. Harold Nissen

[57] ABSTRACT

The timer mechanism for use in a clock has a rotatable minute setting drum and a rotatable hour setting drum coaxial therewith each manually settable to a selected position to set a set time in terms of minute and hour, respectively. A first, a second and a third stationary contact member are arranged in the space between the minute and the hour setting drum for cooperating with switch contacts of first and second rotatable contact members so as to constitute together with the latter members a switch for the timer mechanism for actuating an electric device or an electrically operable warning device of the clock at a set time set by the minute and the hour setting drum.

8 Claims, 6 Drawing Figures

TIMER MECHANISM FOR USE IN A CLOCK

BACKGROUND OF THE INVENTION

The present invention relates to a timer mechanism for use in a digital clock for actuating an electric device or an electrically operated warning device incorporated in the digital clock at a set time set in the timer mechanism.

Heretofore, a timer mechanism of the type described above has been proposed wherein a minute setting drum is provided separately from the hour setting drum so that both the drums are manually operated to set a set time with respect to a pair of timing mechanisms, respectively, at which time a pair of switches connected in series are closed by the respective hour and minute setting drums to actuate a warning device and the like. Such a timer mechanism enables the warning device and the like to be actuated in an accurate time. Alternatively, the pair of timing mechanism are mechanically coupled with each other so as to actuate a single switch for actuating the warning device and the like at the set time.

However, the prior art timer mechanisms as described above are complicated in construction and require a high cost for manufacture as well as a large space thereby rendering them very difficult to be incorporated in a small size portable clock.

The present invention aims at avoiding the above described disadvantages of the prior art timer mechanism.

SUMMARY OF THE INVENTION

An object of the present invention is to provide a novel and useful timer mechanism for use in a clock for actuating an electric device of an electrically operated warning device incorporated in the clock or located exteriorly of the clock at a set time set in the timer mechanism which avoids the disadvantages of the prior art timer mechanism described above.

Another object is to provide a timer mechanism of the type described above which is compact and simple in construction, inexpensive to manufacture and accurate in operation for actuating the warning device and the like at a set time.

The above objects are achieved in accordance with the present invention by providing a timer mechanism for use in a clock having a first rotatable member adapted to be rotated at a rate relating to the advance of minute of a time and a second rotatable member adapted to be rotated at a rate relating to the advance of an hour of time and provided with an electric source and an electric device or an electrically operable warning device, the timer mechanism having a switch adapted to be closed at a set time set in the timer mechanism for connecting the electric source to the electric device or the electrically operable warning device so as to operate the latter at the set time, the timer mechanism being characterized in that the switch comprises a minute setting drum having a pair of diametrically oppositely oriented through-holes therein and adapted to be manually rotated to a selected position and held thereat so as to set the set time in terms of minute, a first rotatable contact member driven by the first rotatable member and having a pair of switch contacts adapted to be passed through the through-holes in the minute setting drum when aligned therewith during the rotation of the first contact member, an hour setting drum arranged coaxially with the minute setting drum at the side thereof opposite to that at which the first contact member is located and having a pair of diametrically oppositely oriented through-holes therein and adapted to be manually rotated to a selected position and held thereat so as to set the set time in terms of hour, a second rotatable contact member located at the side of the hour setting drum opposite to the side at which the minute setting drum is located and driven by the second rotatable member and having a pair of switch contacts adapted to be passed through the through-holes in the hour setting drum when aligned therewith during the rotation of the second contact member, a first stationary contact member, a second stationary contact member and a third stationary contact member, the first, second and third stationary contact members being so arranged between the minute setting drum and the hour setting drum so as to cooperate with the first and second rotatable contact members that they are electrically connected to each other only when the switch contacts of both of the first and the second rotatable contact members are passed through the respective through-holes of the minute and hour setting drums thereby permitting the electric device or the electrically operable warning device to be operated at the set time.

In the preferred embodiment of the present invention, the first rotatable contact member is rotated half a revolution per hour and the minute setting drum bears thereon two series of indications each in terms of minute for an hour while the second rotatable contact member is rotated one revolution per 24 hours and the hour setting drum bears thereon a series of indication in terms of hour for 24 hours, one of the switch contacts of the second rotatable contact member having a projection preventing that one of the switch contacts from being passed through the throughhole while one of the through-holes of the hour setting drum is provided with a recess receiving that projection so that both the switch contacts of the second rotatable contact member are permitted to be passed through the through-holes of the hour setting drum only when the one of the switch contacts having the projection is aligned with the one of the through-holes having the recess.

The first stationary contact member may be in the form of a semicircular contact segment positioned along the path of movement of the switch contacts of the first rotatable contact member and the second stationary contact member is likewise in the form of a semicircular contact segment positioned along the path of movement of the switch contacts of the second rotatable contact member, while the third stationary contact member has a pair of semicircular contact segments each positioned along the path of movement of the switch contacts of the first or the second rotatable contact member complementary with respect to the first or the second stationary contact member.

This arrangement greatly facilitates the cooperation of the first and the second rotatable contact member with the first, the second and the third stationary contact member and insures accurate operation of the switch.

DETAILED DESCRIPTION OF THE PREFERRED EMBODIMENTS

Figure 1:
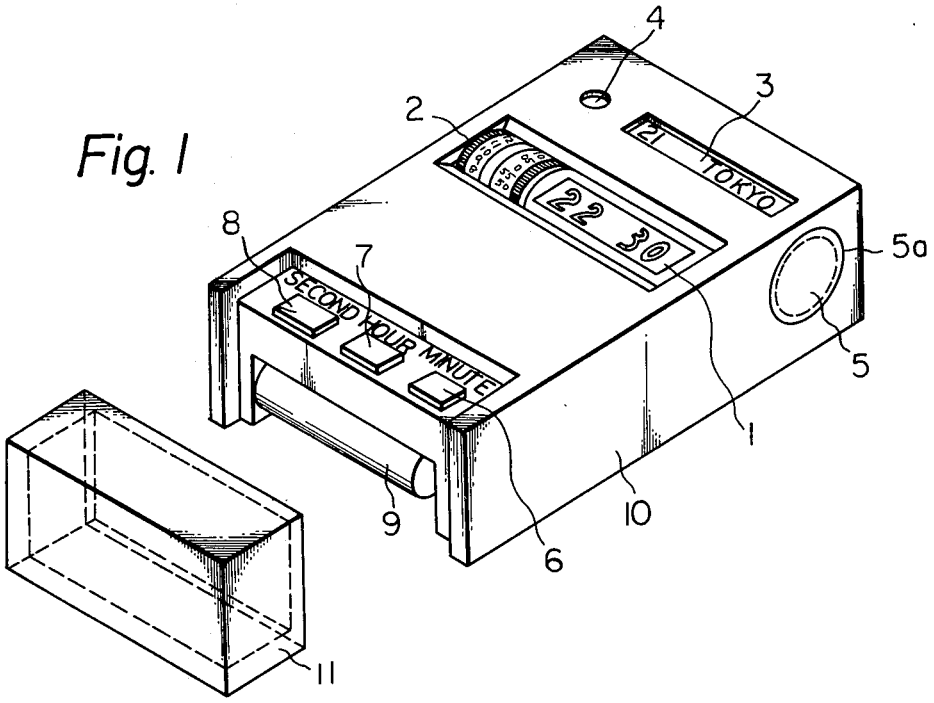
FIG. 1 is a perspective view showing the general appearance of the digital clock of 24 hour indicating system incorporating the timer mechanism constructed in accordance with the present invention with a protecting cover being shown removed from the case of the digital clock.

The digital clock of 24 hour indicating system incorporating the timer mechanism of the present invention shown in FIG. 1 comprises a case 10. Within the case 10, the hour and minute indicating portion 1, the timer setting portion 2 for actuating a warning device or the like at a set time, the city indicating portion 3 for indicating regional time differentials at various locations in the world indicated in the portion 3 by using the portion 1, the light emitting inspecting portion 4 for checking the proper operation of the reference clock pulse generating circuit, the minute indication adjusting portion or knob 6, the hour indication adjusting portion or knob 7, the second stepping portion or knob 8 for resetting the actuation of the reference clock pulse generating circuit and an electric source such as a battery 9 are incorporated. The manually operable knob 5 covered by a flexible cover 5*a* is adapted to actuate the city indicating portion 3 for the indication of the time differential at the location indicated by the portion 3. The removable protecting cover 11 is provided in order to cover the portions 6, 7 and 8 and the battery 9.

Figure 2:
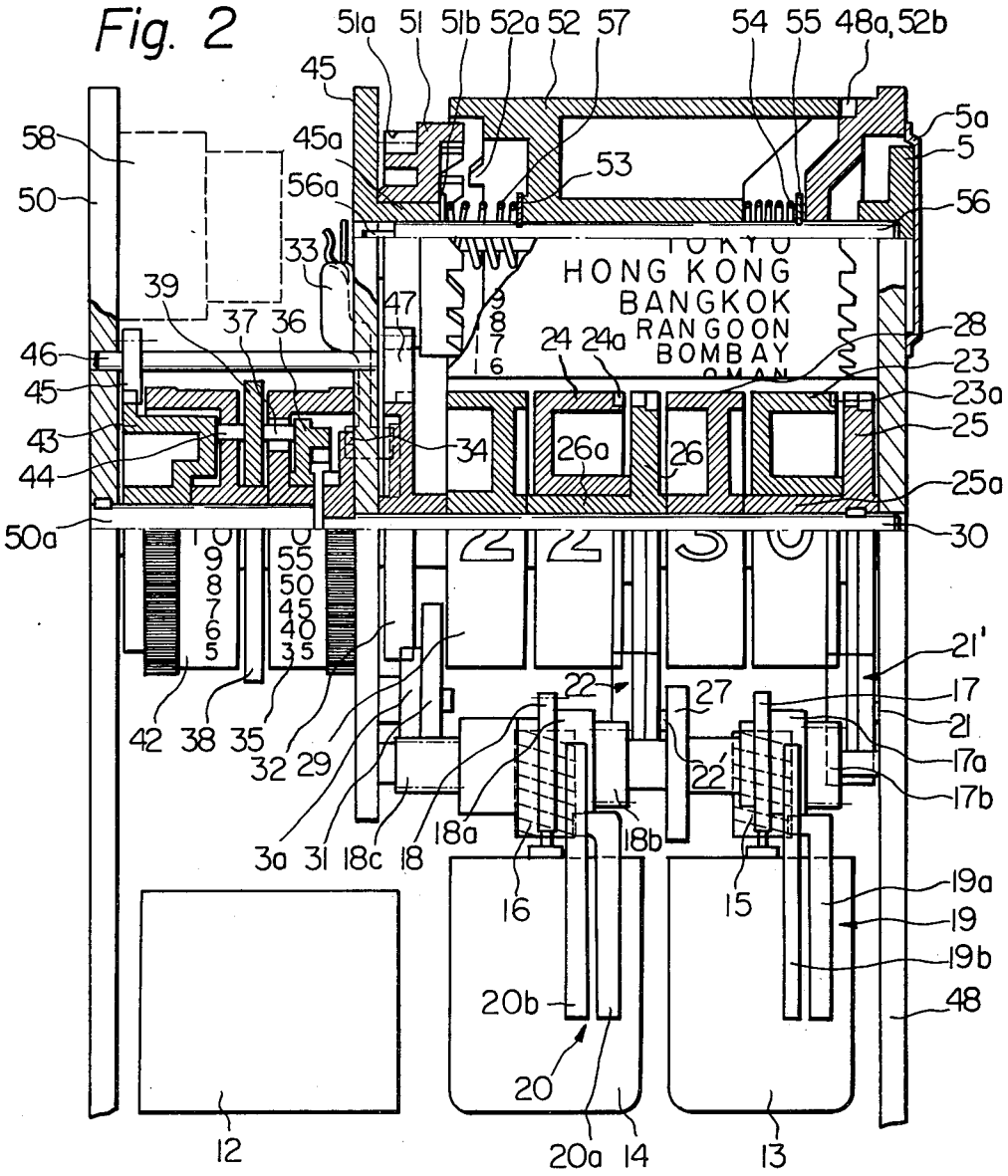
FIG. 2 is a front view of FIG. 1 partly in section and with portions broken away to show the main components of the digital clock of FIG. 1.
Figure 3:
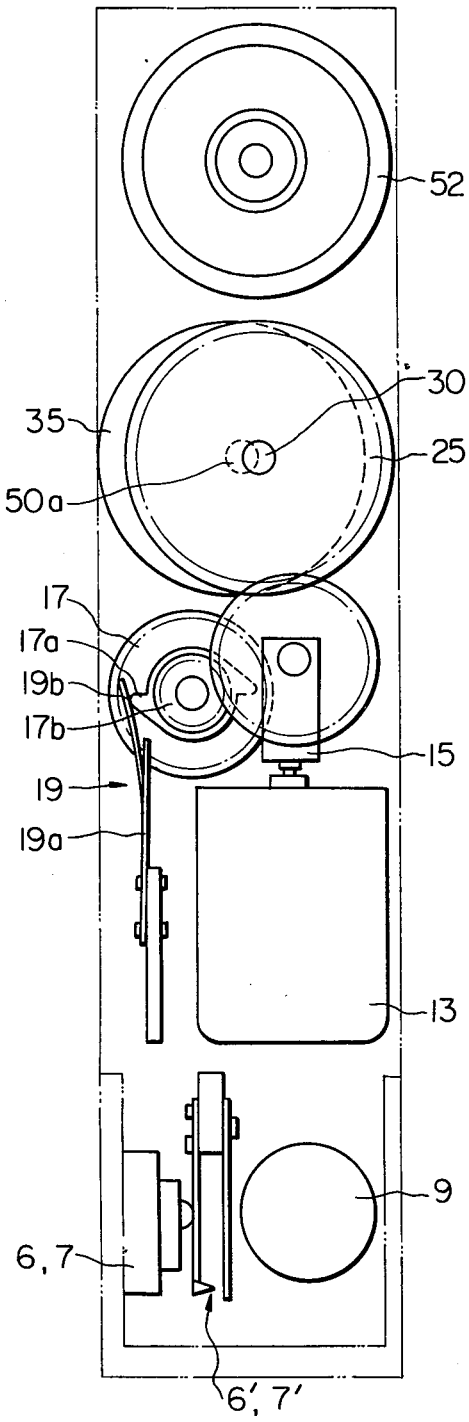
FIG. 3 is a schematic side view of FIG. 2.
Figure 4:
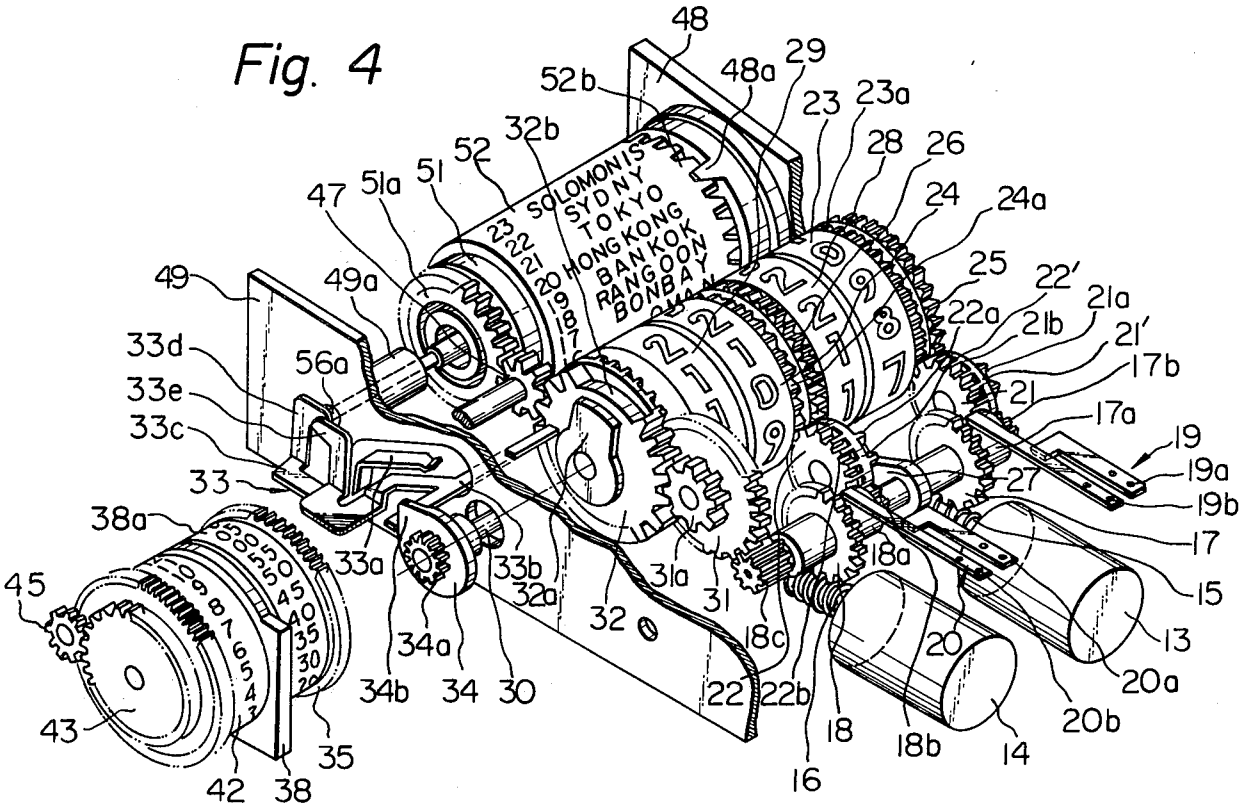
FIG. 4 is a perspective view showing the main components of the digital clock of FIG. 1.

Referring to FIGS. 2 to 4, the digital clock according to the present invention comprises a first driving motor 13 for actuating the minute indicating drum assembly to be described later and a second driving motor 14 separate from the first driving motor 13 for actuating the hour indicating driven assembly to be described later, both the driving motors 13, 14 being energized by an electric source such as the battery 9 through an electric circuit to be described later.

A worm 15 secured to the driving shaft of the motor 13 engages with a worm wheel 17 rotatably supported by a shaft (not shown) supported by a bracket 27 to the case of the digital clock and the frame 48, 49 so as to be driven by the motor 13 when energized. A cam 17*a* having a pair of diametrically oppositely oriented projecting cam portions (FIG. 3) and a pinion 17*b* are integrally formed with the worm wheel 17 and the pinion 17*b* meshes with a gear 21 rotatably supported in the case by a shaft (not shown) while the cam 17*a* cooperates with a switch 19 consisting of a stationary contact 19*a* and a movable contact 19*b*. The switch 19 is connected to the motor 13 as described later and, in the initial position or in the rest position thereof it is held opened by the cam 17*a* but it has the tendency to be brought into the closed position so that, as the motor 13 is energized by means to be described later at intervals of one minute, the cam 17*a* is rotated through the worm wheel 17, the switch 19 is closed and is held in its closed position to continue the energization of the motor 13 until one of the projecting cam portions of the cam 17*a* abuts against the movable contact 19*b* of the switch 19 to open the same after half a revolution of the cam 17*a* thereby deenergizing the motor 13 and stopping the same at the position at which the switch 19 is held opened by the cam 17*a*.

The minute indicating drum assembly comprises a units of figure of minute indicating drum 23 bearing on the periphery thereof numerals 0 to 9 indicative of the units of figure of minute of the time and a tens of figure of minute indicating drum 28 bearing on the periphery thereof numerals 0 or blank and 1 to 5 indicative of tens of figure of minute. In the embodiment shown in FIGS. 2-4, the drum 28 has a series of numerals consisting of 0,0, 1,1, 2,2, 3,3, — 5,5.

As shown in FIG. 2, the ones of figure of minute indicating drum 23 is rotatably supported on a sleeve 25*a* fixedly secured to a shaft 30 which is rotatably supported by the frames 48, 49 of the digital clock and the sleeve 25*a* is coupled with the tens of figure of minute indicating drum 28 likewise supported on the shaft 30 by means such as projection — recess engagement formed at the mating portions of the sleeve 25*a* and the drum 28 so that the latter is rotated together with the sleeve 25*a* and the shaft 30. The sleeve 25*a* is integrally formed with a gear 25 at the end thereof remote from the drum 28 so that the ones of figure of minute indicating drum 23 is located between the tens of figure of minute indicating drum 28 and the gear 25. This arrangement permits the drum 23 to be located closely adjacent to the drum 28 so that the clear indication in tens and ones of figures of minute is achieved in comparison with the prior art in which a partition is provided between the two drums.

The drum 23 is formed with gear teeth 23*a* at the side adjacent to the gear 25.

As shown in FIG. 4, the gear 21 meshes with the gear teeth 23*a* of the ones of figures of minute indicating drum 23 so that the latter is rotated each time the motor 13 is energized at intervals of one minute. The gear ratio between the pinion 17*b*, the gear 21 and the gear teeth 23*a* is so selected that the ones of figure of minute indication of the drum 23 is switched to the succeeding indication with respect to the rotation of the pinion 17*b* and, hence, the cam 17*a* and the worm wheel 17 by half a revolution, thereby permitting the ones of figure of minute indication to be switched to the succeeding indication at intervals of one minute so as to complete the cycle of indication of 0 to 9 minutes in ones of figure of minute in every ten minutes.

The gear 21 is integrally formed with a sectional gear portion or intermittently meshing gear portion 21*a* including for example, two teeth separated from the gear 21 by a disc-like portion 21', and the sectional gear portion 21*a* is adapted to intermittently mesh with the gear 25 of the tens of figure of minute indicating drum 28 so as to intermittently drive the latter. The driving relationship between the gear 21, the gear teeth 23*a*, the sectional gear portion 21*a* and the gear 25 is so determined that the indication of the tens of figure of minute indicating drum 28 is switched two times each time the ones of figure of minute indicating drum 23 completes one cycle of indication of 0 to 9 minutes in ones of figure of minute and the indication is returned to 0 minute indication thereby permitting the tens of figure of minute indication to be switched in every ten minutes by virtue of the arrangement of numerals 0,0, 1,1, — 5,5 in the drum 28. However, in case the arrangement of numerals in the drum 28 is made a series of 0, 1, 2, — 5, then the driving ratio of the sectional gear portion 21*a* and the gear 20 with respect to the gear ration between the gear 21 and the gear teeth 23*a* is made such that the indication of the drum 28 is switched to the succeeding indication each time one cycle of indication of 0 to 9 minutes in the drum 23 is completed and the indication is returned to a 0 minute indication.

In like manner as in the case of the driving motor 13, a worm 16 is secured to the driving motor 14 for the hour indicating drum assembly, and the worm 16 meshes with a worm wheel 18 similar to the worm wheel 17. The worm wheel 18 has a cam 18*a* and a pinion 18*b* integrally formed therewith which are similar to the cam 17*a* and the pinion 17*b*, respectively. The cam 18*a* cooperates with a switch 20 connected to the motor 14 and consisting of a stationary contact 20*a* and a movable contact 20*b* similar to those of the switch 19, and the pinion 18*b* meshes with a gear having a sectional gear portion 22*a* and a disc like portion 22' similar to those of the gear 21. Thus, when the motor 14 is energized by means described later, the cam 18*a* is driven so as to close the switch 20 to continue the energization of the motor 14 thereby rotating the gear 22 until half a revolution of the cam 18*a* is completed to again open the switch 20 to deenergize and stop the motor 14 to maintain the switch 20 in the opened position.

As best seen in FIG. 2, the arrangement and configuration of the ones of figure of hour indicating drum 24 having gear teeth 24*a* and the tens of figure of hour indicating drum 29 having sleeve 26*a* and gear 26 supported on the shaft 30 are similar to those of the drums 23 and 28 on the shaft 30 except that the sleeve 26*a* is freely rotatably supported on the shaft 30. Thus, the drums 24, 29 are arranged closely to each other for the clear indication of hour. The gear teeth 24*a* of the ones of figure of hour indicating drum 24 meshes with the gear 22 while the sectional gear portion 22*a* is adapted to intermittently engage with the gear 26 of the tens of figure of hour indicating drum 29 so as to drive the drums 24, 29 at the related rate to each other in like manner as in the case of the drums 23, 28.

The ones of figure of hour indicating drum 24 bears on the periphery thereof numerals of 0 to 9 indicative of ones of figure of hour, while the tens of figure of hour indicating drum 29 bears on the periphery thereof numerals 0 or blank and 1 and 2 arranged in such a way that two series of 0 (or blank), 0 (or blank), 1, 1, 2, 0 (or blank) are located over the entire periphery of the drum 29.

The driving relationship between the drums 24 and 29 as effected by the actuation of the gear 22, the sectional gear portion 22*a*, the gear teeth 24*a* and the gear 26 is so determined that the indication of the tens of figure of hour indicating drum 29 is switched two times each time one cycle of indication of 0 to 9 hours by the ones of figure of hour indicating drum 24 is completed and the indication thereof is switched from 9 hour indication to 0 hour indication. Of course, the switching of the indication of the tens of figure of hour indicating drum 29 may be made once each for one revolution of the drum 24 if a series of 0 (or blank), 1, 2 is given on the drum 29 with the corresponding gear ratio being given to gear train 18*b*, 22*a*, 26.

In order to intermittently actuate the motor 14 so that the ones of figure of hour indicating drum 24 is stepwise rotated by 1/10 revolution per hour so as to switch successively 0 to 9 hour indication in ones of figure of hour at intervals of one hour, a cam 34 having a projecting cam portion 34*b* is fixedly secured to the shaft 30 integrally secured to the tens of figure of minute indicating drum 28 through the sleeve 25*a* as shown in FIG. 4, the cam 34 being located exterior of the frame 49, and a switch 33 having a stationary contact 33*a* and a movable contact 33*b* extending laterally in parallel to the axis of the shaft 30 is arranged so as to cooperate with the cam 34 and is connected to the motor 14. Since the tens of figure of minute indicating drum 28 and, hence, the shaft 30 integral therewith are rotated one revolution per hour as described previously, the cam 34 is also rotated one revolution per hour so that the switch 33 is closed once per hour by the cam 34 so as to energize the motor 14 once per hour. The orientation of the cam 34 with respect to the movable contact 33*b* of the switch 33 is so determined that the motor 14 is energized by the switch 33 each time the indication of the tens of minute indicating drum 28 is switched from numeral 5 to 0 (or blank). Once the motor 14 is energized and the cam 18*a* is rotated, the switch 20 is closed and held closed to continuingly rotate the ones of figure of hour indicating drum 24 so as to switch the indication thereof to the succeeding indication and is again opened by the cam 18*a* a stop the motor 14, this being repeatedly effected at intervals of an hour by virtue of the cam 34 having a single projecting cam portion 34*b* and rotated one revolution per hour by the shaft 30.

Thus, the indication of the hour indicating drum assembly is successively switched per hour to exhibit in sequence the series of indications 0 (or blank) 0; 0 (or blank) 1; 0 (or blank) 2; — 9 (or blank) 9; 10; 11; 12; — 19; 20; 21; 22; — at intervals of an hour.

However, the indications of 24, 25, — 29 hour must be removed from the above mentioned hour indicating drum assembly in order to complete the digital clock of 24 hour indicating system. To this end, means is provided for skipping the indications of 24, 25, — 29 hour so as to directly return the indication to 0 hour indication when the 23 hour indication is to be switched to the succeeding hour indication.

Such means comprises a cam 32*a* integrally secured to a gear 32 rotatably supported on the shaft 30 and meshing with a pinion 31*a* integral with an idler gear 31 which in turn meshes with a pinion 18*c* integral with the worm wheel 18 driven by the motor 14. The gear ratio of the gear train 18*c*, 31, 31*a* and 32 is so determined that the cam 32*a* is rotated one revolution as the ones of figure of hour indicating drum 24 is rotated by 3 revolutions through the gear train 18, 18*b*, 22 and 24*a* by the motor 14.

The cam 32*a* cooperates with the extended end of the movable contact 33*b* of the switch 33 consisting of the stationary contact 33*a* and the movable contact 33*b* (FIG. 4) so as to close the switch 33 for driving the motor 14 when the switch 33 is actuated by the cam 32*a*. The configuration and arrangement of the cam 32*a* with the switch 33 are so determined that the switch 33 is closed by the cam 32*a* when the indication of the hour indicating drum assembly is switched from 23 hour indication to the succeeding indication and is held closed to continuingly drive the motor 14 so as to skip the indication of 24, 25, — 29 hour until 0 hour indication is reached at which time the switch 33 is released from the cam 32*a* so as to be opened to deenergize the motor 14 thereby starting the indication from 0 hour indication.

The provision of a pair of motors for driving the minute and the hour indicating drum assembly separately from each other together with the coupling mechanisms therefor as described above permits the construction of the digital clock of 24 hour indicating system to be extremely simple.

In order to exhibit regional time differentials at various locations in the world, a city indicating drum 52 bearing thereon names of various cities or locations in the world having different time differentials is mounted on a shaft 56 which is axially shiftably supported by a boss 49*a* of the frame 49 and a through-hole in a recess formed in the frame 48 as shown in FIG. 2.

A compression spring 57 is arranged around the shaft 56 between the boss 49*a* and a snap ring 53 secured to the shaft 56 so that the shaft 56 is normally urged toward the right as seen in FIG. 2 but it is arrested in the arrested position by a snap ring 55 secured to the shaft 56 and abutting against the mating face of the recess in the frame 48. The city indicating drum 52 is held between the snap ring 53 and the snap ring 55 with a compression spring 54 being interposed between the drum 52 and the snap ring 55 so that the drum 52 is resiliently held against the snap ring 53 by the action of the spring 54. A manually operable knob 5 is located in the recess of the frame 48 and is engaged with one end of the shaft 56 so that the shaft 56 together with the drum 52 is moved axially to the left against the action of the spring 57 by manually pushing the knob 5. The flexible cover 5*a* serves to protect the knob 5 and prevents it from being removed from the case 10.

As best shown in FIG. 4, the side of the city indicating drum 52 adjacent to the frame 48 is formed with serrated teeth 52*b* one or more of which are adapted to normally engage with one or more of teeth formation 48*a* fixedly secured to or integral with the frame 48 so as to releasably arrest the drum 52 in position.

An annular clutch member 51 is rotatably supported on the boss 49*a* of the frame 49 and serrated teeth 51*b* are formed at the side of the member 51 adjacent to the drum 52 as seen in FIG. 2. One or more mating teeth formation 52*a* are formed at the side of the drum 52 adjacent to the clutch member 51 and they are adapted to engage with the serrated teeth 51*b* of the clutch member 51 when the drum 52 is moved toward the left in FIG. 2 by pushing the knob 5 while the serrated teeth 52*b* are disengaged from the serrated teeth formation 48*a* thereby permitting the drum 52 to be rotated by the clutch member 51 when the same is driven.

In order to drive the clutch member 51, a gear 51*a* is integrally formed in the clutch member 51 which is operatively engaged with the gear 32 integral with the cam 32*a* through an idler pinion 47 interposed between the gears 32 and 51*a*.

The gear 32 has a portion 32*b* in which teeth formation is removed. The configuration and orientation of the portion 32*b* with respect to the orientation of the cam 32*a* are so determined that the pinion 47 and, hence, the gear 51*a* are not driven by the gear 32 during the time the motor 14 is continuingly driven by the closure of the switch 33 by means of the cam 32*a* so as to skip the indication of 24, 25, — 29 hours to directly return to 0 hour indication when 23 hour indication is switched to the succeeding hour indication, while the gear 32 per se is at all times driven by the pinion 18*c* through the gear train 31, 31*a* when the motor 14 is energized.

Thus, the revolution of the city indicating drum 52 is made at all times to correspond to the switching of the cyclic indication of 0 to 23 hours by the hour indicating drum assembly for the 24 hour indicating system.

In order to actuate the clutch member 51 by the driving motor 14 through the hour indicating drum assembly so as to exhibit on the hour indicating drum assembly the regional time differentials at various locations in the world as indicated by the city indicating drum 52, the switch 33 is further provided with a stationary contact 33*e* and a movable contact 33*d* cooperating with an actuating piece 56*a* secured to the other end of the shaft 56 as best shown in FIG. 4.

In operation, when the knob 5 is pushed to move the city indicating drum 52 toward the left against the action of the spring 57 to disengage the serrated teeth 52*b* from the teeth formation 48*a* and to engage the teeth formation 52*a* with the serrated teeth 51*b* of the clutch member 51, the actuating piece 56*a* abuts against the movable contact 33*d* of the switch 33 (FIG. 4) so as to bring the same in contact with the stationary contact 33*e* thereby closing the switch 33 for energizing the motor 14. The energization of the motor 14 causes the switching of the hour indication of the hour indicating drum assembly while the city indicating drum 52 is also rotated to indicate the selected name of the city. By arranging the names of cities or locations on the drum 52 so that hour indication as appearing in the hour indicating drum assembly is made to correspond to the time differential at the name of the city indicated by the drum 52, the respective time differentials at various cities or locations can be selectively indicated in the hour indicating portion 1 by the hour indicating drum assembly by merely actuating the knob 5 so as to locate the name of the desired city or location on the city indicating drum 52 in the city indicating portion 3.

Figure 5:
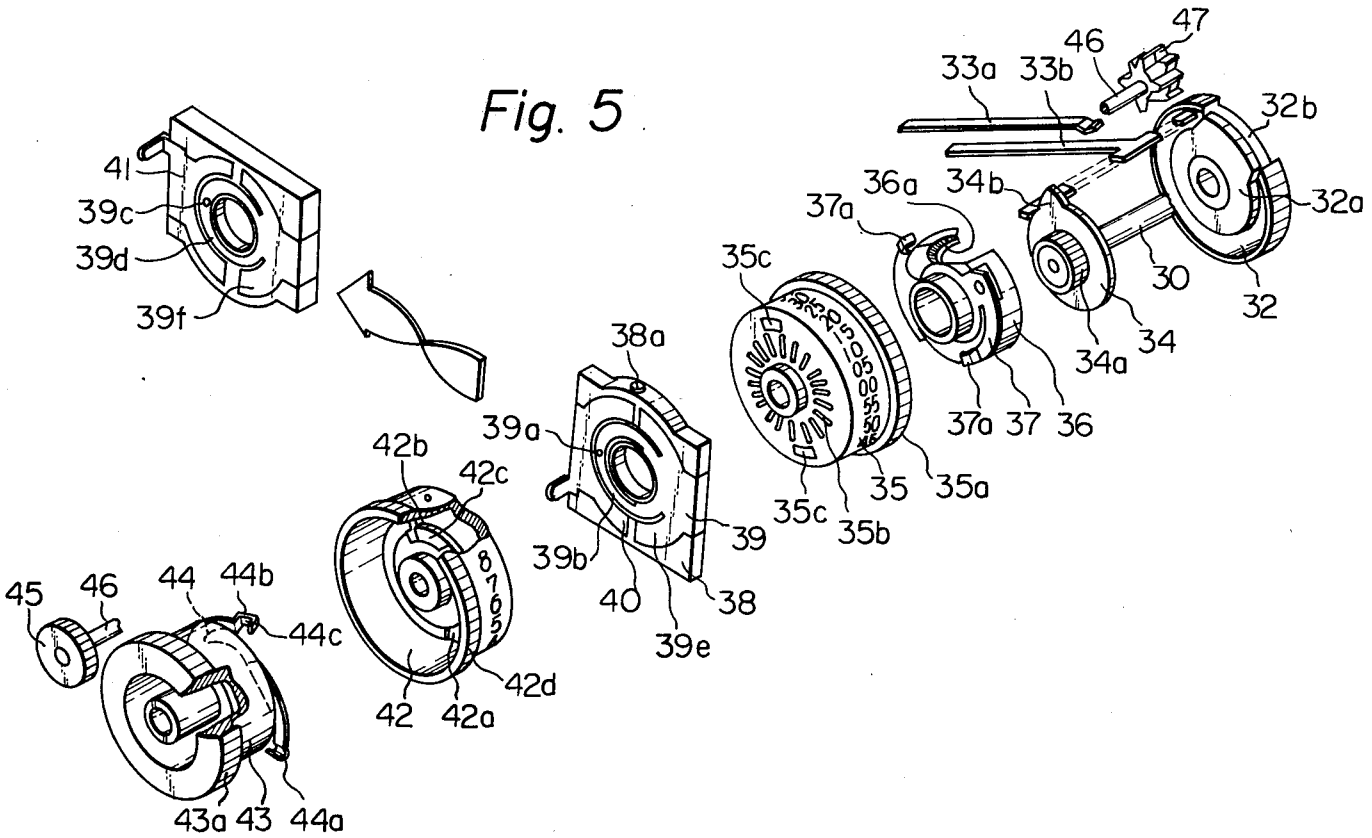
FIG. 5 is an exploded perspective view showing the timer mechanism of the present invention.

FIG. 5 shows the details of the timer mechanism of the present invention incorporated in the digital clock of the present invention.

A shaft 50*a* is fixedly secured to the frame 50 in parallel to the shaft 30 (FIG. 2) but the axis of the shaft 50*a* is offset slightly upward with respect to the shaft 30 as shown in FIG. 3 for the reason to be described later.

A first rotatable contact member 36 of an insulating material has a pair of diametrically oppositely oriented symmetrical switch contacts 37*a*, 37*a* electrically connected to each other and resiliently leftwardly urged (FIG. 3) by a leaf spring member 37 integral with the switch contacts 37*a*, 37*a* and secured to the contact member 36, and the contact member 36 is rotatably supported on a boss formed in a minute setting drum 35 which is in turn rotatably supported on the shaft 50*a* as shown in FIG. 2. The contact member 36 has integrally formed therewith an internal gear 36*a* and the internal gear 36*a* is by virtue of the offset positioning of the shaft 50*a* with respect to the shaft 30 engaged with a pinion 34*a* integrally secured to the cam 34 which is rotated one revolution per hour as described previously. The gear ratio of the internal gear 36*a* with respect to the pinion 34*a* is so selected that the contact member 36 is rotated half a revolution per one revolution of the pinion 34*a*, i.e., per hour.

The minute setting drum 35 is in the cup-shaped form housing therein the contact member 36 and carries on the periphery thereof two series of numerals 00, 05, 10, 15, — 55 indicative of minute of the time and a knurled portion 35*a* facilitating the manipulation of the drum 35. Since the shaft 50*a* is offset upwardly from the shaft 30, the knurled portion 35*a* is made easily accessible from the upper surface of the case 10 as shown in FIG. 3.

The minute setting drum 35 has a pair of diametrically oppositely oriented symmetrical through-holes 35c, 35c through which the pair of switch contacts 37a, 37a are passed to be projected to the left side of the drum 35 when aligned therewith.

In order to permit the drum 35 to be held at set position for setting the minute of the time at which the timer mechanism is to be actuated, the drum 35 is provided with a plurality of circumferentially arranged recesses 35b each adapted to be snugly engaged with a projection 39c resiliently held by a leaf spring 39d on a stationary contact supporting insulating member 38 (shown in up-side down inverted position in FIG. 5) to be described later in detail so that the drum 35 is held in a selected set position.

A cup-shaped hour setting drum 42 of an insulating material bears on the periphery thereof a series of numerals of 0, 1, 2, — 23 indicative of the hour of the time and a knurled portion 42d for easy manipulation of the drum 42 and has a central sleeve so that the drum 42 is rotatably supported on the shaft 50a. The stationary contact supporting insulating member 38 is supported on the sleeve of the drum 42 between the minute setting drum 35 and the hour setting drum 42 close to each other as shown in FIG. 2. The member 38 is held stationary regardless of the rotation of the sleeve of the drum 42 by means (not shown) such as a partition of the case 10 located adjacent to the outer edge of the member 38.

In the similar manner as in the case of the drum 35, the drum 42 is provided with a plurality of circumferentially arranged recesses (not shown), a selected one of which is snugly engageable with a projection 39a resiliently held by a leaf spring 39b on the stationary contact supporting member 38 so that the drum 42 is held at a selected set position. The drum 42 has a through-hole 42a and a through-hole 42b diametrically oppositely oriented with respect to the through-hole 42a symmetrically therewith but having a recess 42c adjacent thereto to be described later.

A second rotatable contact member 43 of an insulating material is rotatably supported on the shaft 50a in the drum 42 as shown in FIG. 2 and is formed with a gear 43a appearing exterior of the drum 42 which engages with a pinion 45 secured to one end of a shaft 46, the other end of which fixedly supports the idler pinion 47 engaging with the gears 32 and 51a. The gear ratio between the pinion 45 and the gear 43a is made equal to that between the pinion 47 and the gear 32. Since the gear 32 is rotated one revolution per 24 hour period as previously described because it is rotated twice by 1/3 of one revolution for each 10 hours, but the one-third revolution occurring at the third time (after lapse of 20 hours) is skipped after the lapse of four hours at the switching of the indication of 23 hours to the succeeding indication so as to directly return to 0 hour indication by virtue of the provision of the cam 32a and the switch 33, the second contact member is also rotated one revolution per 24 hours.

The contact member 43 is provided with a switch contact 44a resiliently urged toward the drum 42 by a leaf spring member 44 secured to the contact member 43 and a switch contact 44b having a projection 44c diametrically oppositely oriented with respect to the switch contact 44a symmetrically therewith and electrically connected to the switch contact 44a and resiliently urged toward the drum 42 by the leaf spring member 44. The configuration and the arrangement of the switch contacts 44a, 44b and the projection 44c with respect to the through-holes 42a, 42b and the recess 42c are so determined that the switch contact 44a can be passed through any of the through-holes 42a, 42b when aligned therewith but the switch contact 44b having the projection 44c can only be passed through the through-hole 42b when aligned because of the provision of the recess 42c adapted to receive the projection 44c but it is prevented from being passed through the through-hole 42a because the projection 44c obstructs the passing of the switch contact 44b through the through-hole 42a, thereby permitting both the switch contacts 44a and 44b to be passed through the respective through-holes 42a, 42b simultaneously only when the switch contact 44b is aligned with the through-hole 42b.

The stationary contact supporting member 38 supports thereon a first semicircular stationary contact member 41 located along the path of movement of the switch contacts 37a, 37a of the first rotatable contact member 36 so as to be contacted with the switch contact 37 is passed through the through-hole 35c of the minute setting drum 35 located in the range of the contact member 41. In the similar manner, a second semicircular stationary contact member 40 is secured on the member 38 along the path of movement of the switch contacts 44a, 44b of the second rotatable contact member 43 so as to be contacted therewith when either of the switch contacts 44a, 44b is passed through either of the through-holes 42a, 42b of the hour setting drum 42 located in the range of the contact member 40.

A third stationary contact member 39 has a pair of semicircular contact segments 39f and 39e, one of which segment 39f is located along the path of movement of the switch contacts 37a complementally with respect to the contact member 41 for cooperating with the switch contacts 37a while the other segment 39e is located along the path of movement of the switch contacts 44a, 44b complementally with respect to the contact member 40 for cooperating with the switch contacts 44a, 44b thereby permitting all the first, the second and the third stationary contact member 41, 40 and 39 to be electrically connected to each other when the first and the third stationary contact member 41, 39 are contacted with the respective switch contacts 37a, 37a passed through the through-holes 35c, 35c of the minute setting drum 35 and the second and the third stationary contact member 40, 39 are contacted with the switch contacts 44a, 44b passed through the through-holes 42a, 42b, respectively.

The first and the second stationary contact member 41, 40 are connected to an electrical device or an electrically operable warning device 58 so as to be energized by an electric source when the contact members 41, 39, 40 are electrically connected to each other at the set time as described later.

In operation of the timer mechanism of the present invention described above, the minute and the hour setting drum 35 and 42 are manually adjusted to a desired set time. Then, the first and the third stationary contact members 41, 39 are electrically connected to each other by the switch contacts 37a, 37a each time the set time in terms of minute of the time is reached in every hour by virtue of the one-half revolution per hour of the contact member 36 having a pair of switch contacts 37a, 37a and two series of numerals 00, 05 — indicative of the minute formed on the minute setting drum 35 while the second and the third contact members 40, 39 are electrically connected to each other by the switch contacts 44a, 44b permitted to contact with the contact members 40, 39 at a set time in terms of hour in 24 hours so as to actuate the warning device and the like at the set time.

The construction of the above described timer mechanism insures a very high accuracy in operation of the time by virtue of the provision of the minute and the hour setting drum manually settable separately from each other.

Figure 6:
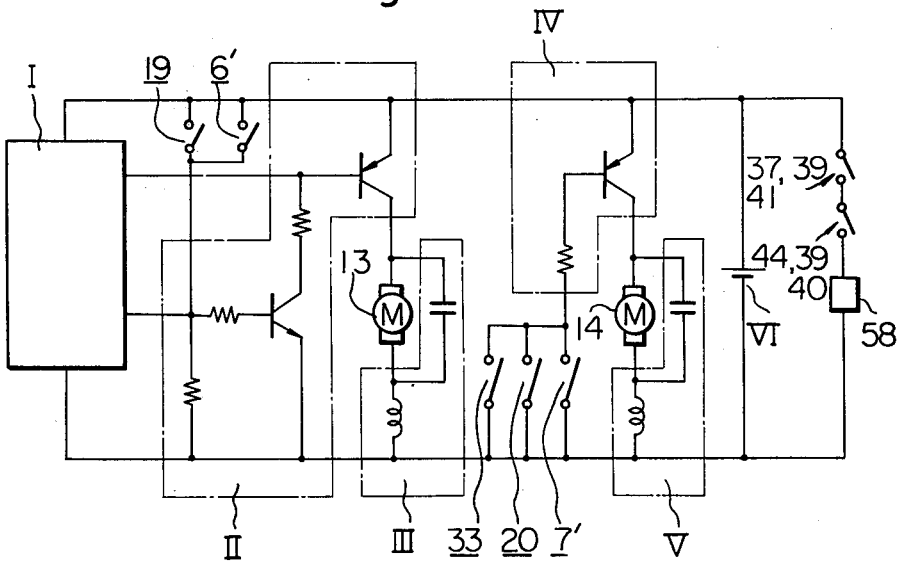
FIG. 6 is a diagram showing the electric circuit incorporated in the digital clock of FIG. 1.

FIG. 6 shows the electric circuit incorporated in the digital clock of the present invention.

The electric circuit comprises a reference clock pulse generating device I including a quartz oscillator or a tuning fork for generating a signal per minute, a first switching circuit II for energizing the motor 13 upon receipt of the signal from the generating device I and the signal from the closed switch 19, a second switching circuit IV for energizing the motor 14 upon receipt of the signal from the closed switch 33 and the closed switch 20, an electrical source VI and the electric device or the warning device 58, the circuits III and V serving as circuits for preventing electric noise from the motors 13, 14, respectively.

Each of the above described components is conventional in the art, and, therefore, detailed description thereof is unnecessary.

The previously described switches and other components are connected in the circuit as shown in FIG. 6 and the operation thereof is clear from the previous description.

The switches 6', 7' shown connected in the circuit of FIG. 6 are schematically shown in FIG. 3 as being closed by the operation of the respective adjusting knobs 6, 7 shown in FIG. 1 so as to adjust the time in terms of minute and hour, respectively, by energizing the motor 13 or 14 upon actuation of the respective knob 6, 7.

I claim:

1. In a timer mechanism for use in a clock having a first rotatable member adapted to be rotated at a rate relating to advance of individual minutes of time and a second rotatable member adapted to be rotated at a rate relating to advance of individual hours of time and provided with an electric source and an electric device, said timer mechanism having a switch adapted to be closed at a set time preset in said timer mechanism to connect said electric source to said electric device so as to operate the latter at said preset time, said switch comprising:

a minute setting drum having a pair of diametrically oppositely oriented through-holes therein and adapted to be manually rotated to a selected position and held thereat so as to set said set time in terms of minute;

a first rotatable contact member driven by said first rotatable member and having a pair of switch contacts adapted to be passed through said through-holes in said minute setting drum when aligned therewith during the rotation of said first contact member;

an hour setting drum arranged coaxially with said minute setting drum at the side thereof opposite to that at which said first contact member is located and having a pair of diametrically oppositely oriented through-holes therein and adapted to be manually rotated to a selected position and held thereat so as to set said set time in terms of hours;

a second rotatable contact member located at the side of said hour setting drum opposite to the side at which said minute setting drum is located and driven by said second rotatable member and having a pair of switch contacts adapted to be passed through said through-holes in said hour setting drum when aligned therewith during the rotation of said second contact member;

a first stationary contact member in the form of a semicircular contact segment positioned along the path of movement of said switch contacts of said first rotatable contact member;

a second stationary contact member in the form of a semicircular contact segment positioned along the path of movement of said switch contacts of said second rotatable contact member; and a third stationary contact member having a pair of semicircular contact segments each positioned along the path of movement of said switch contacts of said first or said second rotatable contact member complementary with respect to said first or said second stationary contact member.

2. Timer mechanism according to claim 1, wherein:

said first, second and third stationary contact members are arranged between said minute setting drum and said hour setting drum to cooperate with said first and second rotatable contact members that they are electrically connected to each other only when said switch contacts of both of said first and said second rotatable contact members are passed through the respective through-holes of said minute and hour setting drums thereby permitting said electric device to be operated at said preset time.

3. Timer mechanism according to claim 1, wherein:

said first rotatable contact member is rotated a half of a revolution per hour;

said minute setting drum carrying two series of figure indicia to indicate the individual minutes in a single hour;

said second rotatable contact member being moved through one revolution for each 24 hours;

said hour setting drum carrying thereon figure indicia to indicate the individual hours in a single 24 hour period;

one of said switch contacts of said second rotatable contact member having a projection preventing said one of said switch contacts from being passed through one of said through-holes; and one of said through-holes of said hour setting drum being provided with a recess for receiving said projection so that both said switch contacts of said second rotatable contact member are premitted to be passed through said through-holes of said hour setting drum only when said one of said switch contacts is aligned with said one of said through-holes.

4. Timer mechanism according to claim 3, wherein:

said three stationary contact members are positioned between said minute and said hour setting drums;

said stationary contact members cooperating with said first and said second rotatable contact members for electrically intercoupling them solely when said switch contacts of both said first and said second rotatable contact members pass through the respective through-holes of said minute and said hour setting drums, thereby permitting said electric device to be operated at said preset time.

5. Timer mechanism according to claim 1, including:

a stationary contact supporting member for supporting said first, said second and said third stationary contact members; and said stationary contact supporting member being positioned between said minute setting drum and said hour setting drum.

6. Timer mechanism according to claim 5, wherein said first and said second stationary contact members include:

a pair of oppositely facing semi-circular contact portions positioned in a predetermined path on opposite sides of said stationary contact supporting member; and said third stationary contact member includes a pair of oppositely facing semi-circular contact segments positioned in a predetermined path on opposite sides of said stationary contact supporting member.

7. Timer mechanism according to claim 6, wherein:

said switch contacts of said first rotatable contact member cooperates with said segment and said contact portion on one side of said stationary contact supporting member to follow their predetermined path on the one side; and said switch contacts of said second rotatable contact member cooperates with said segment and said contact portion on the other side of said stationary contact supporting member to follow their predetermined path on the other side.

8. Timer mechanism according to claim 2, wherein said first rotatable contact member is rotated half a revolution per hour and said minute setting drum bears thereon two series of indications each in terms of minute for an hour while said second rotatable contact member is rotated one revolution per 24 hours and said hour setting drum bears thereon a series of indication in terms of hour for 24 hours, one of said switch contacts of said second rotatable contact member having a projection preventing said one of said switch contacts from being passed through said through-hole while one of said through-holes of said hour setting drum is provided with a recess receiving said projection so that both said switch contacts of said second rotatable contact member are permitted to be passed through said through-holes of said hour setting drum only when said one of said switch contacts is aligned with said one of said through-holes.

* * * * *